US005664671A

United States Patent [19]

Nedblake, Jr.

[11] Patent Number: 5,664,671

[45] Date of Patent: Sep. 9, 1997

[54] COMBINATION CONTAINER

[76] Inventor: Greydon Wesley Nedblake, Jr., 9800 N. Revere Ave., Kansas City, Mo. 64154

[21] Appl. No.: 638,935

[22] Filed: Apr. 25, 1996

[51] Int. Cl.[6] ..... B65D 77/00

[52] U.S. Cl. ..... 206/217; 206/497; 206/541; 206/546; 206/548; 220/23.83

[58] Field of Search ..... 206/217, 219, 206/221, 430, 432, 497, 541, 546, 548, 549; 220/4.27, 4.28, 4.26, 23.83, 23.86; 215/6

[56] References Cited

U.S. PATENT DOCUMENTS

| | | | |
|---|---|---|---|
| D. 344,892 | 3/1994 | Robie et al. . | |
| 378,752 | 2/1888 | Ader | 215/6 |
| 861,815 | 7/1907 | Cullen | 220/4.27 |
| 896,903 | 8/1908 | Ferry | 206/217 |
| 908,205 | 12/1908 | Clapp | 220/4.27 |
| 1,249,641 | 12/1917 | Lefrancois | 215/6 |
| 2,604,976 | 7/1952 | Sarg . | |
| 2,611,499 | 9/1952 | Mayer . | |
| 2,679,281 | 5/1954 | Paulucci | 206/430 |
| 3,113,668 | 12/1963 | Taylor | 206/430 |
| 3,143,205 | 8/1964 | Ruderian | 215/6 |
| 3,292,810 | 12/1966 | Schechter | 206/497 |
| 3,348,716 | 10/1967 | Nakata | 215/6 |
| 3,413,128 | 11/1968 | Steinbarth et al. . | |
| 3,563,449 | 2/1971 | Hampton et al. . | |
| 3,638,787 | 2/1972 | Phillips, Jr. | 206/430 |
| 3,642,499 | 2/1972 | Castell . | |
| 4,196,808 | 4/1980 | Pardo | 206/432 |
| 4,706,839 | 11/1987 | Spence | 206/497 |
| 4,795,028 | 1/1989 | Wittig et al. . | |
| 4,864,921 | 9/1989 | Ross . | |
| 5,050,757 | 9/1991 | Hidding et al. . | |
| 5,056,659 | 10/1991 | Howes et al. . | |
| 5,129,520 | 7/1992 | Gaspar . | |
| 5,165,546 | 11/1992 | Jaeger et al. | 215/6 |
| 5,318,787 | 6/1994 | Brauner et al. . | |
| 5,366,089 | 11/1994 | Parker | 206/549 |
| 5,372,827 | 12/1994 | Brauner et al. . | |
| 5,401,200 | 3/1995 | Ellis . | |
| 5,465,150 | 11/1995 | Porres Sanchez et al. . | |
| 5,531,353 | 7/1996 | Ward et al. | 220/23.86 |
| 5,586,656 | 12/1996 | Abrums | 220/23.86 |

FOREIGN PATENT DOCUMENTS

| | | | |
|---|---|---|---|
| 1450220 | 7/1966 | France | 206/497 |
| 1724 | 2/1886 | United Kingdom | 215/6 |
| 3599 | 3/1913 | United Kingdom | 215/6 |

*Primary Examiner*—David T. Fidei

*Attorney, Agent, or Firm*—Hovey, Williams, Timmons & Collins

[57] ABSTRACT

A combination container includes a first container containing a beverage and presenting a base, a second container containing an edible solid and presenting an upper surface engaged with the base of the first container, and a band of heat-shrunk material surrounding the containers on either side of the joint therebetween for coupling the containers into a unitary package. In preferred forms, the heat-shrunk material forms a channel at the joint between the containers to facilitate gripping of the package and the channel is perforated to allow detachment of containers from one another.

5 Claims, 1 Drawing Sheet

COMBINATION CONTAINER

BACKGROUND OF THE INVENTION

1. Field of the Invention

The present invention relates to the field of packaging. More particularly, the invention is concerned with a combination container including a first container containing a beverage and presenting a base, a second container containing an edible solid and presenting an upper surface engaged with the base of the first container, and a band of heat-shrunk material surrounding the containers on either side of the joint therebetween for coupling the containers into a unitary package.

2. Description of the Prior Art

The prior art has recognized the need to present items that must be packaged separately as a unitary package for distribution efficiency and consumer convenience. For example, a beverage and an edible solid may need to be individually packaged, but it may be desirable to market the two as a unitary package. Such might include coffee and a pastry, juice and a sandwich, or soup and a salad. A unitary package facilitates distribution especially through vending machines.

The prior art, however, has not adequately addressed the need for unitary packaging of different products. For example, U.S. Pat. No. 2,604,976 discloses containers that require custom configurations. This and other prior art attempts have not presented a unitary package that is economical to assembly yet adaptable for a wide variety of products.

SUMMARY OF THE INVENTION

The combination container of the present invention solves the prior art problems discussed above and provides a distinct advance in the state of the art. More particularly, the invention hereof provides for a unitary package of separately packaged and dissimilar products.

The preferred embodiment of the present invention includes a first container presenting a base, a second container presenting an upper surface abutting the base, and a band of material surrounding the side walls of the containers on either side of the joint thereof for coupling the containers. In preferred forms, the band is composed of heat-shrunk material that conforms to the container side walls and to the joint to form a channel that aids in gripping the package. A line of weakness such as perforations are defined in the channel of the band to allow detachment of the two containers.

DETAILED DESCRIPTION OF THE PREFERRED EMBODIMENT

Figure 2:
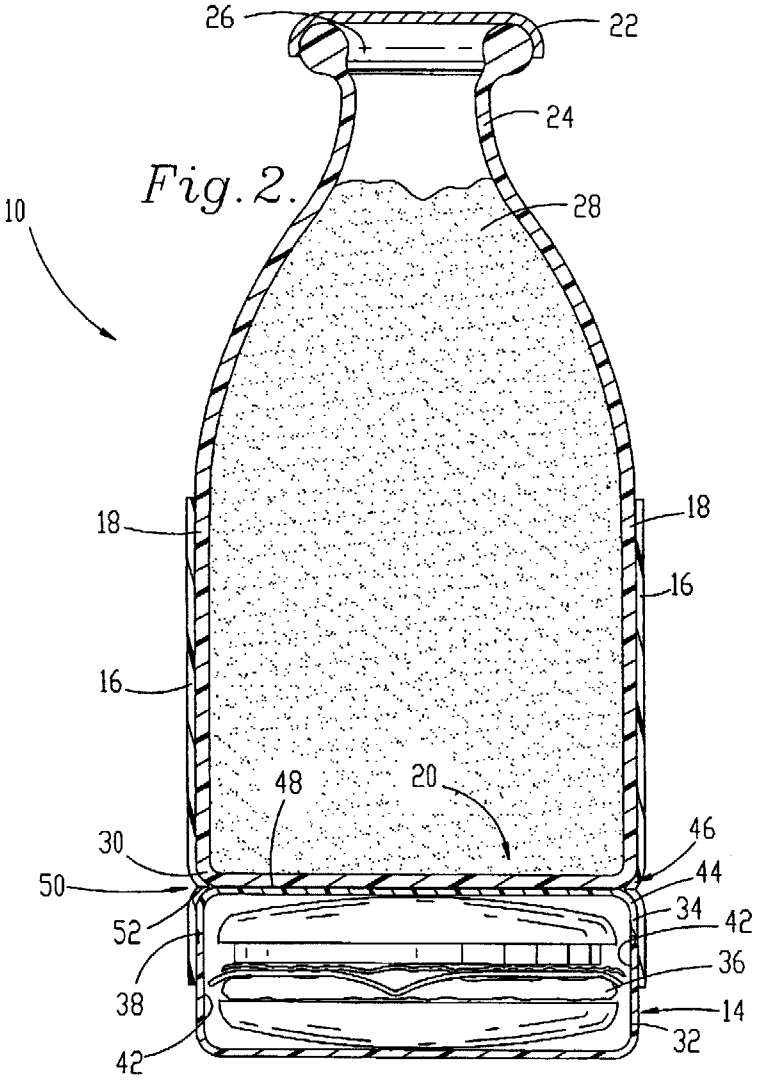
FIG. 2 is a sectional view of the package of FIG. 1.
Figure 1:
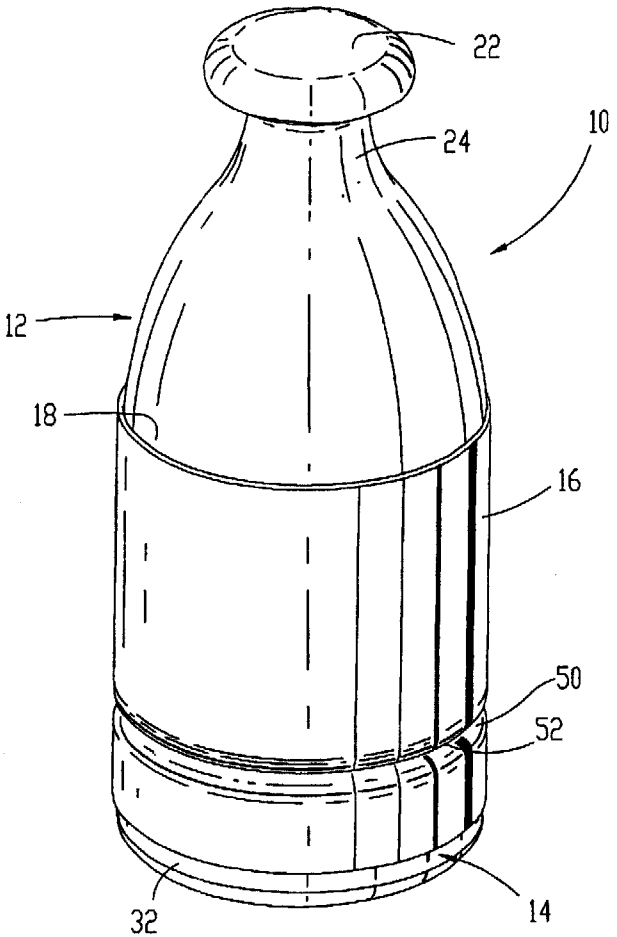
FIG. 1 is a perspective view of the preferred combination container presenting a unified package in accordance with the present invention.

Referring to the drawing figures, preferred package 10 includes upper container 12, lower container 14 and coupling band 16. Upper container 12 includes side walls 18, base 20 and cap 22. As illustrated, side walls 18 taper to form neck 24 presenting a diameter less than that of side walls 18 adjacent base 20. Neck 24 terminates in outlet 26 opposed to base 20 for discharge of liquid 28 such as a soft drink and is closed by compression cap 22. It will be appreciated that cap 22 can take other configurations such as a threaded cap. The juncture between side walls 18 and base 20 presents a surrounding curved surface or radius 30.

Lower container 14 includes lower section 32 and cover 34 configured as shown and also contains edible solid 36 such as a sandwich. Cover 34 engages lower section 32 at joint 38 and presents upper surface 40 configured to mate with and engage base 20 as shown in FIG. 2. Lower section 32 and cover 34 cooperate to present lower container side walls 42, preferably configured to present the same diameter in cross-section as upper container side walls 18. Lower container is preferably composed of synthetic resin material safe for use in a microwave oven. This allows container 14 to be placed in a microwave oven in order to heat the contents thereof.

The juncture between upper surface 40 and side walls 42 also present a surrounding curved surface or radius 44. As illustrated in FIG. 2, upper container radius 30 and lower container radius 44 cooperate to present a groove or recess 46 in surrounding relationship with package 10 at joint 48 between containers 12 and 14.

Coupling band 16 is preferably composed of a heat shrinkable synthetic resin film such as MOBIL-VISION film that shrinks about 8% on heating. Band 16 surrounds side walls 18 and 42 in a spanning relationship with joint 48. In the manufacture of package 10, uncured film would be wrapped snugly about containers 12, 14 and then heat applied. The film would then shrink to securely couple containers 12, 14. Moreover, coupling band 16 conforms to recess 46 to present channel 50, also surrounding package 10 at joint 48. Channel 50 aids in gripping package 10 which is especially useful if package 10 presents moisture on the exterior of band 16 or if the consumer's hand is slippery.

Coupling band 16 also includes a line of weakness 52, preferably perforations, defined in channel 50. With this line of weakness 52, the consumer can twist containers 12, 14 relative to one another whereupon coupling band 16 breaks at line of weakness 52 in order to separate containers 12, 14.

Package 10 is ideally suited for a wide variety of liquid and solid combinations, especially beverages and solid food. These combinations might include a soft drink and a sandwich, juice and a pastry, and so forth. Moreover, the heat-shrink nature of coupling band 16 allows the combination of containers not specifically designed to be part of a unitary package. For example, lower container 14 can be combined with a conventional single serving soft drink bottle and this allows unitary package 10 to be dispensed from existing vending machines. In this way, such a vending machine can dispense package 10 as a light lunch or snack combination rather than being limited to only dispensing soft drinks. Additionally, it is not required that upper and lower containers 12, 14 present the same diameter or even the same cross-sectional configuration. It will also be appreciated that the unitary package can include more than two containers.

I claim:

1. A unitary package comprising:

a first container adapted for holding a beverage and having a sidewall, an integral base transverse to said sidewall, and structure defining an openable outlet remote from said base for discharging and drinking of said beverage directly from the outlet;

a second container adapted to hold an edible solid and having separable upper and lower sections presenting a juncture therebetween, said upper section having a top wall and a depending sidewall, said lower section having a bottom wall and an upstanding sidewall, said upper and lower sections cooperatively defining an enclosed region for receiving said edible solid, said first and second containers being oriented in a superposed relationship with the base of said first container adjacent the top wall of the upper section and defining a joint therebetween, said base and upper section top wall cooperatively defining a continuous, concave, circumferentially extending recess at said joint; and coupling means detachably interconnecting said first and second containers and including a band of heat-shrunk material surrounding portions of the first and second containers, spanning said joint therebetween, and having a portion thereof extending into said recess, said material band including an upper segment above said recess and snugly engaging said first container sidewall, a lower segment below said recess and snugly engaging said upper section sidewall and said lower section sidewall and spanning said juncture therebetween, and a line of weakness at said portion of the band extending into said recess, said first and second containers being manually separable from one another by relative twisting motion between the first and second containers operable to separate said upper and lower material band segments at said line of weakness.

2. The package of claim 1, said first and second container sidewalls presenting substantially the same cross-sectional diameter.

3. The package of claim 1, said separable sections of said second container being formed of material suitable for allowing placement of the second container in a microwave oven for heating of said edible solid.

4. The package of claim 1, the sidewall and base of said first container having a thickness greater than the thickness of the walls of said upper and lower sections of said container.

5. The package of claim 1, said line of weakness including perforations.

* * * * *